US012378022B2

(12) United States Patent
Zagnoni et al.

(10) Patent No.: US 12,378,022 B2
(45) Date of Patent: Aug. 5, 2025

(54) PACKAGING MACHINE

(71) Applicant: PLUSLINE S.R.L., Zola Predosa (IT)

(72) Inventors: Christian Zagnoni, Calcara Valsamoggia (IT); Leonardo Stamati, Bologna (IT)

(73) Assignee: PLUSLINE S.R.L., Zola Predosa (IT)

( * ) Notice: Subject to any disclaimer, the term of this patent is extended or adjusted under 35 U.S.C. 154(b) by 55 days.

(21) Appl. No.: 18/284,544

(22) PCT Filed: Apr. 6, 2022

(86) PCT No.: PCT/IT2022/050081

§ 371 (c)(1),
(2) Date: Sep. 28, 2023

(87) PCT Pub. No.: WO2022/224283

PCT Pub. Date: Oct. 27, 2022

(65) Prior Publication Data

US 2024/0174392 A1 May 30, 2024

(30) Foreign Application Priority Data

Apr. 20, 2021 (IT) ..... 102021000009974

(51) Int. Cl.

| | |
|---|---|
| ***B65B 11/22*** | (2006.01) |
| ***B65B 49/08*** | (2006.01) |
| ***B65B 51/02*** | (2006.01) |

(52) U.S. Cl.

CPC ..... *B65B 11/22* (2013.01); *B65B 49/08* (2013.01); *B65B 51/023* (2013.01)

(58) Field of Classification Search

CPC ..... B65B 11/22; B65B 49/08; B65B 51/023; B65B 11/004

USPC ..... 53/209

See application file for complete search history.

(56) References Cited

U.S. PATENT DOCUMENTS

| | | | | |
|---|---|---|---|---|
| 5,228,273 | A * | 7/1993 | Kovacs | B65B 49/06 493/182 |
| 6,067,780 | A * | 5/2000 | Gentili | B65B 25/146 53/376.2 |
| 2002/0059779 | A1* | 5/2002 | Gamberini | B65B 25/146 53/228 |
| 2005/0229538 | A1* | 10/2005 | Dall' Omo | B65B 11/22 53/134.1 |
| 2005/0229546 | A1* | 10/2005 | Poli | B65B 51/14 53/228 |
| 2014/0260087 | A1* | 9/2014 | Antoniazzi | B65B 25/146 53/204 |
| 2019/0270565 | A1* | 9/2019 | Bolognesi | B65D 75/56 |
| 2022/0227515 | A1* | 7/2022 | Gerri | B65B 49/14 |
| 2022/0258889 | A1* | 8/2022 | Pattuzzi | B65B 25/146 |

* cited by examiner

*Primary Examiner* — Anna K Kinsaul
*Assistant Examiner* — Nicholas E Igbokwe
(74) *Attorney, Agent, or Firm* — Rivka Friedman

(57) ABSTRACT

Machine for packaging paper rolls (R) comprising adhesivation means (EG) adapted for applying an adhesive substance (GG) on an internal side of a side flap of a packaging sheet, which adhesivation means act while the rolls (R) pass through an entry station (E) of the machine.

17 Claims, 16 Drawing Sheets

PACKAGING MACHINE

The present invention relates to a machine for packaging products such as rolls of paper, for example rolls of toilet paper or rolls of absorbent paper, using a packaging or wrapping sheet of paper material that wraps the rolls previously grouped and sorted into a pre-established packaging configuration.

It is known that the packaging of paper rolls by means of a packaging sheet, which conventionally consists of a film of plastic material, requires the use of machines, commonly known as packaging machines, equipped with an entry station for the rolls arranged according to a predetermined grouping order, with one or more rows of rolls arranged side by side to form a layer or several superimposed layers of rolls. The rolls are introduced into said entry station by means of an elevator, on which the groups of rolls to be packaged are previously formed. Before introducing the rolls into the packaging machine, a packing sheet is placed on the rolls arranged on the elevator. In a subsequent step in which the rolls cross the aforementioned entry station, the packaging sheet undergoes a first folding, wrapping the rolls upwards and laterally. Then, by means of two movable horizontal surfaces, commonly called folder and counter-folder, the folding of the edges of the packaging sheet protruding vertically at the sides of the package is caused, so that the sheet also wraps the rolls at the bottom. A sealing unit provides for the heat sealing of the edges of the sheet in the lower part of the package. Inside the packaging machine, the paper rolls are moved along a substantially straight path developed between the aforementioned entry station and an exit station for the completed packages. The handling of the packages being formed is carried out by means of a conveyor, commonly known as the "upper drive", specially configured to form a series of compartments in which the individual packages to be completed are received. Inside the packaging machine, further folds of the edges of the packaging sheet are also carried out. For this purpose, the packaging machine is equipped with a folding unit which acts on the heads of the package to be completed to create a so-called "head" folding oriented in the direction of movement imposed by the upper drive.

Examples of packaging machines generally operating according to the scheme described above are provided in W02021/009339A1, W02021/009340A1.

The present invention relates to the packaging of products of the aforementioned type by means of a packaging machine that uses packaging sheets made of paper material which, by their nature, cannot be used in machines conventionally fed with packaging material consisting of a film of plastic material.

The main object of the present invention is to propose a packaging machine configured for the packaging of paper rolls, for example rolls of toilet paper or rolls of absorbent paper, using paper material for making the individual packages.

This result has been achieved, in accordance with the present invention, by adopting the idea of making a machine having the characteristics indicated in claim 1. Other features of the present invention are the subject of the dependent claims.

Thanks to the present invention, it is possible to form packages with packaging sheets made of paper material without introducing substantial modifications in the processes normally adopted in this sector. A further advantage lies in the fact that the present invention can be easily implemented in current packaging machines without introducing particular structural or mechanical complications. These and further advantages and characteristics of the present invention will be more and better evident to every person skilled in the art thanks to the following description and the attached drawings, provided by way of example but not to be considered in a limiting sense, in which:

Figure 1A:
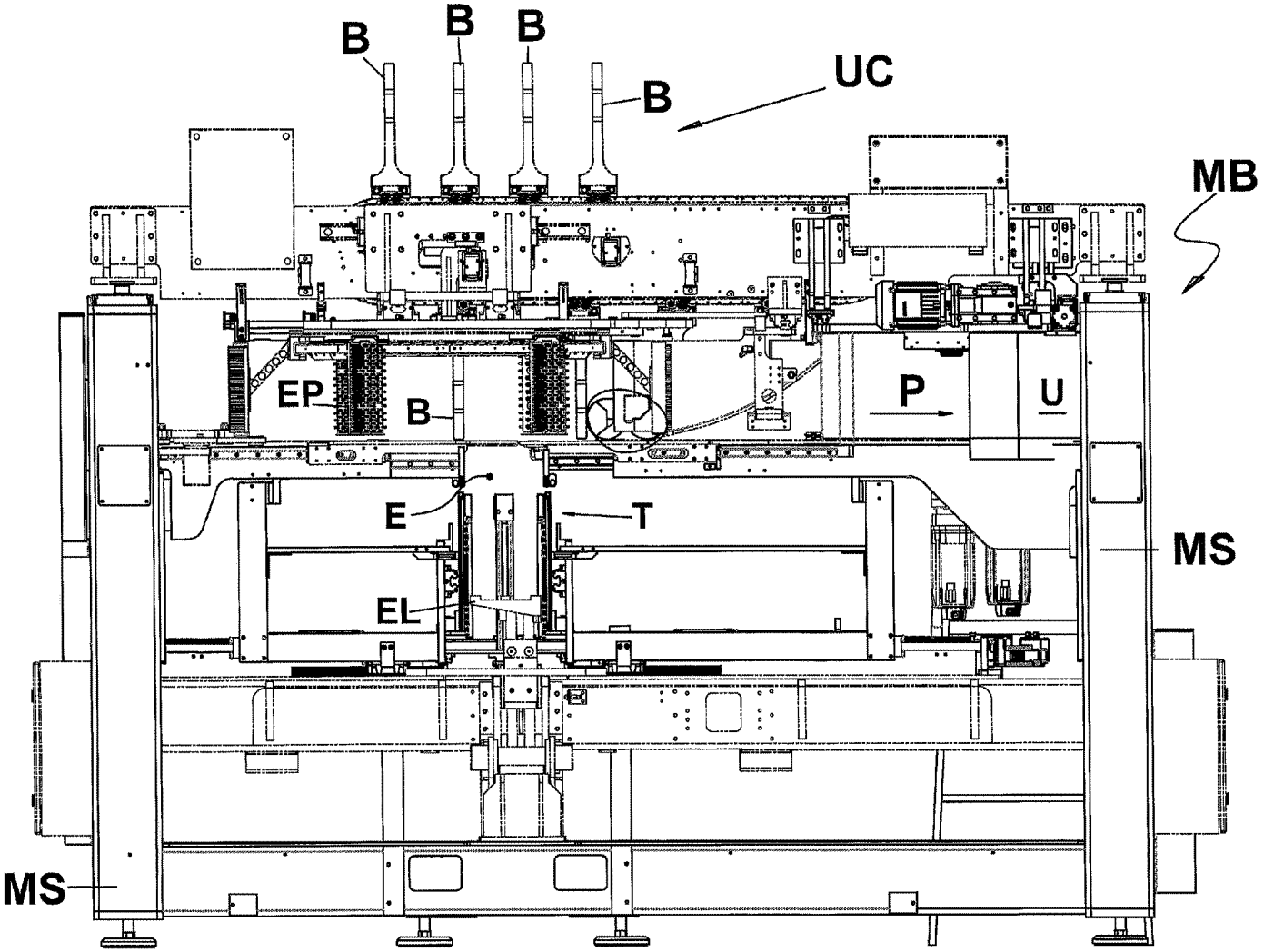
FIG. 1A represents a schematic side view of the main body of a packaging machine according to the present invention.
Figure 5:
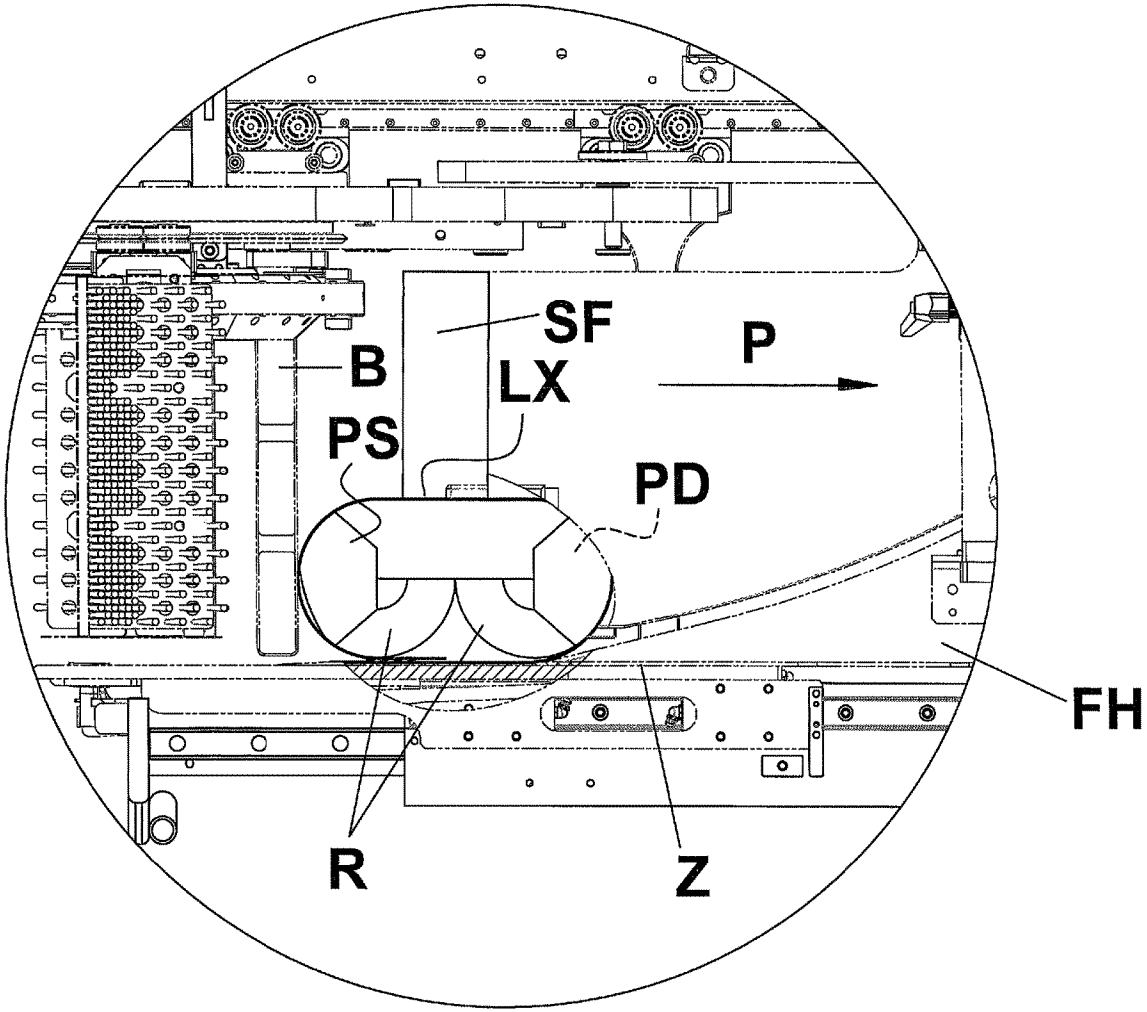
Figure 6:
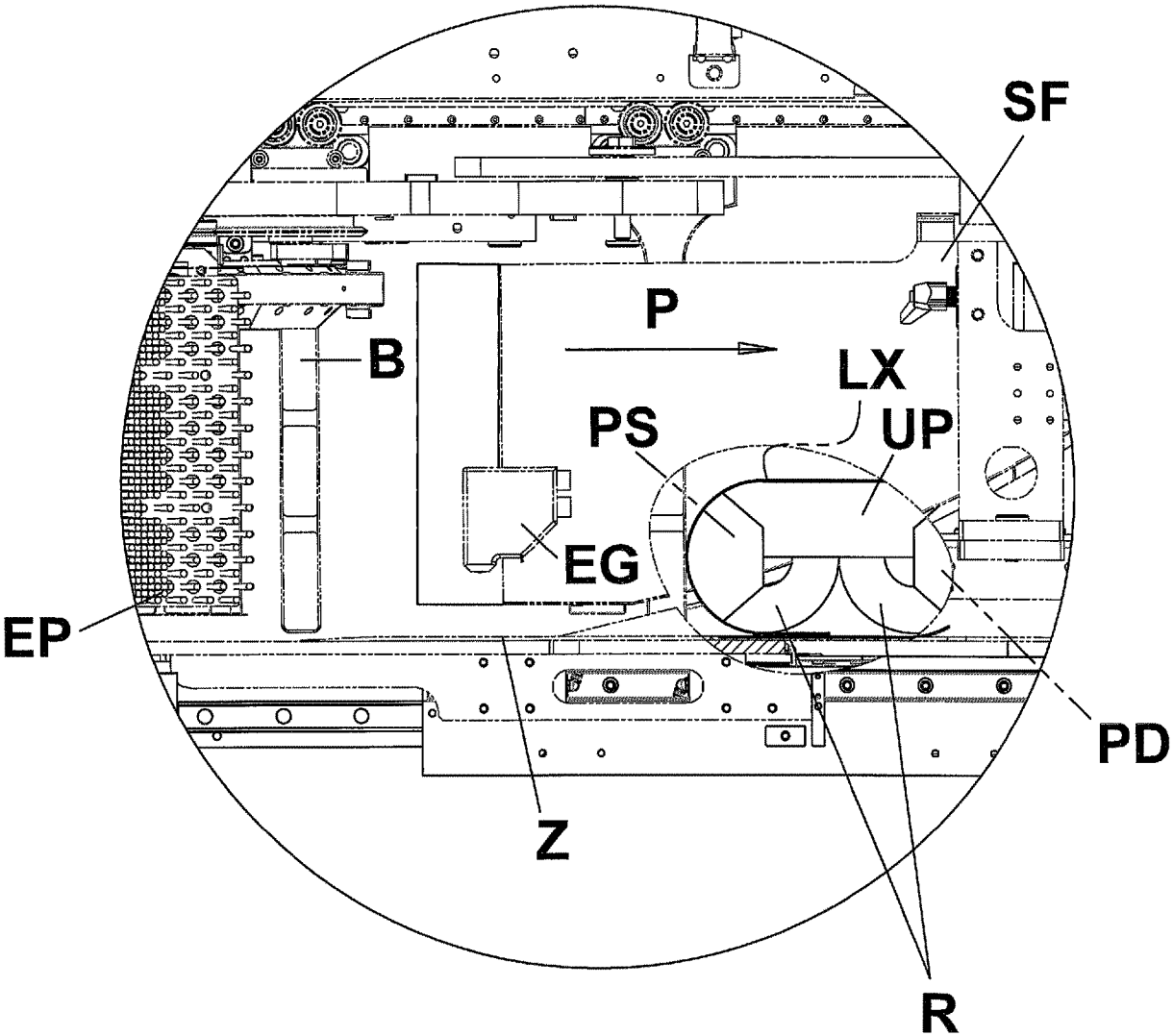
Figure 7:
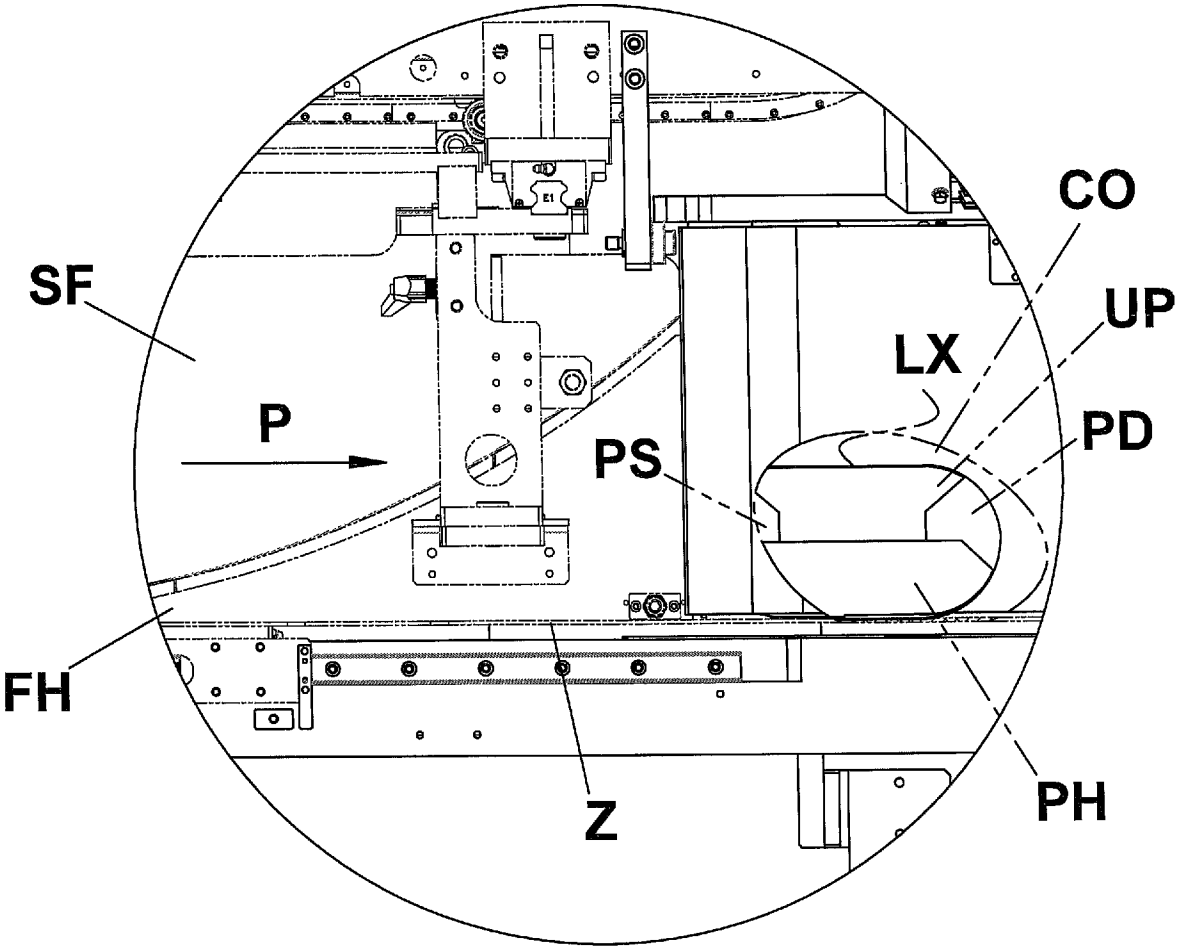
Figure 8:
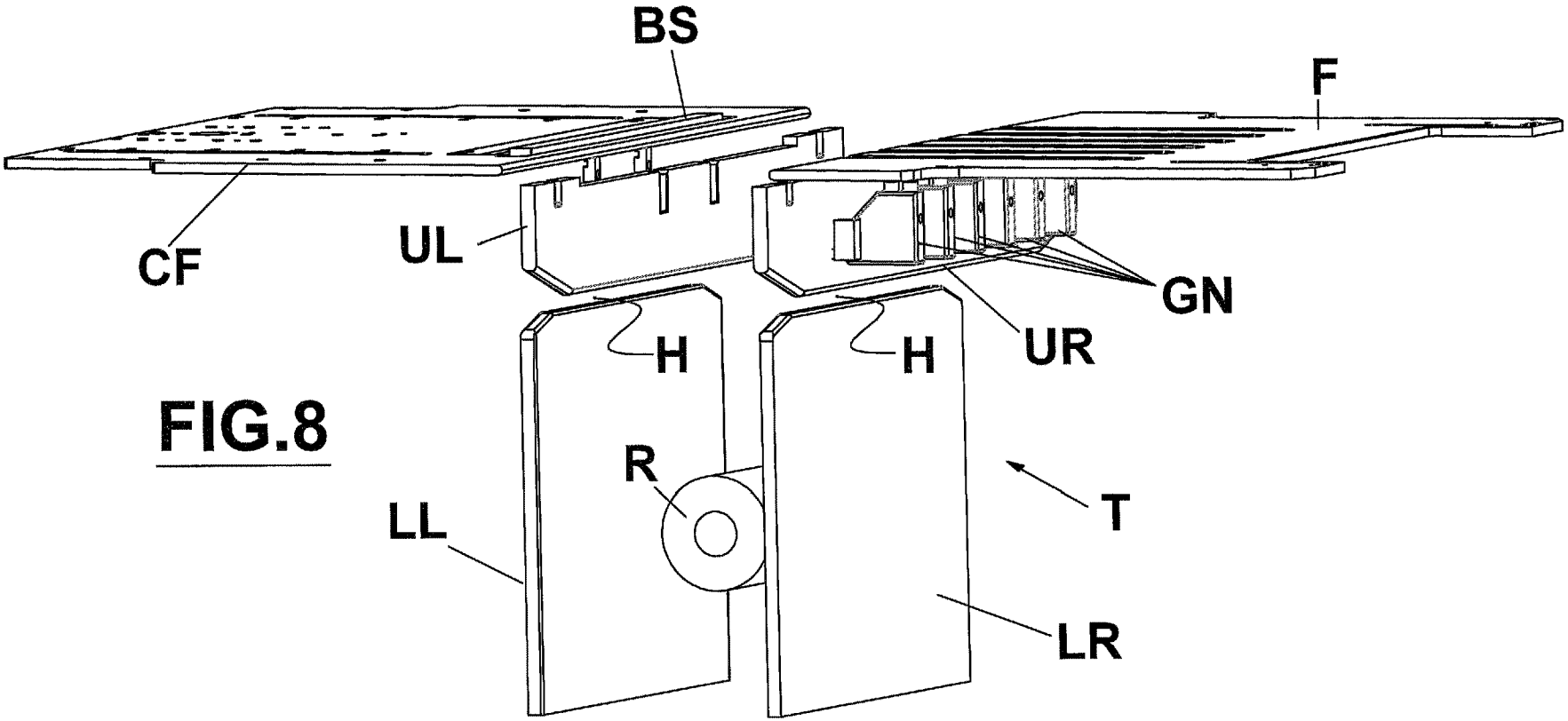
Figure 9:
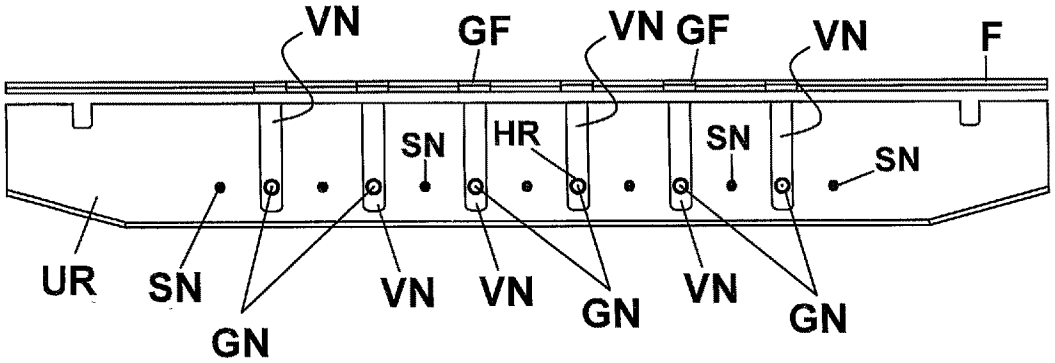
Figure 10:
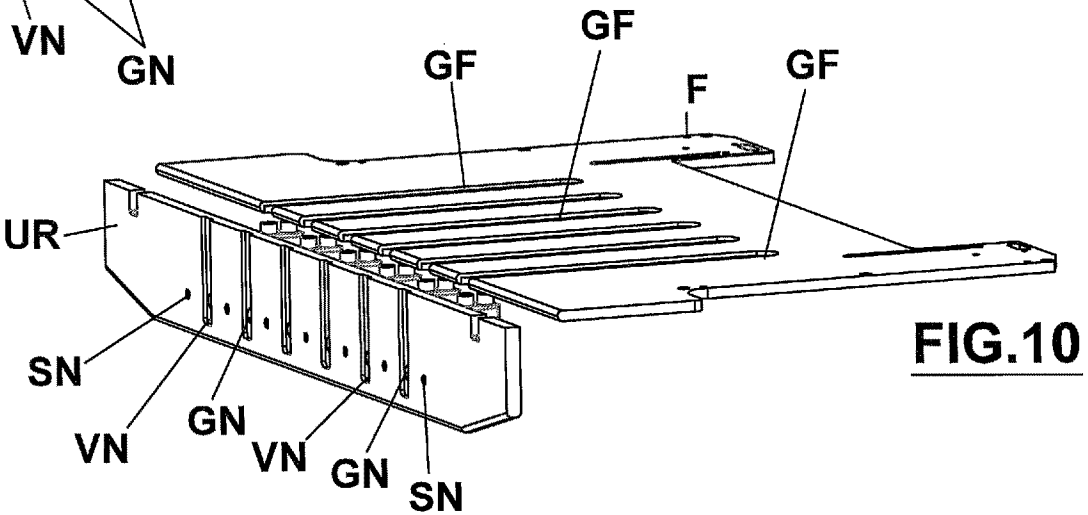
Figure 18:
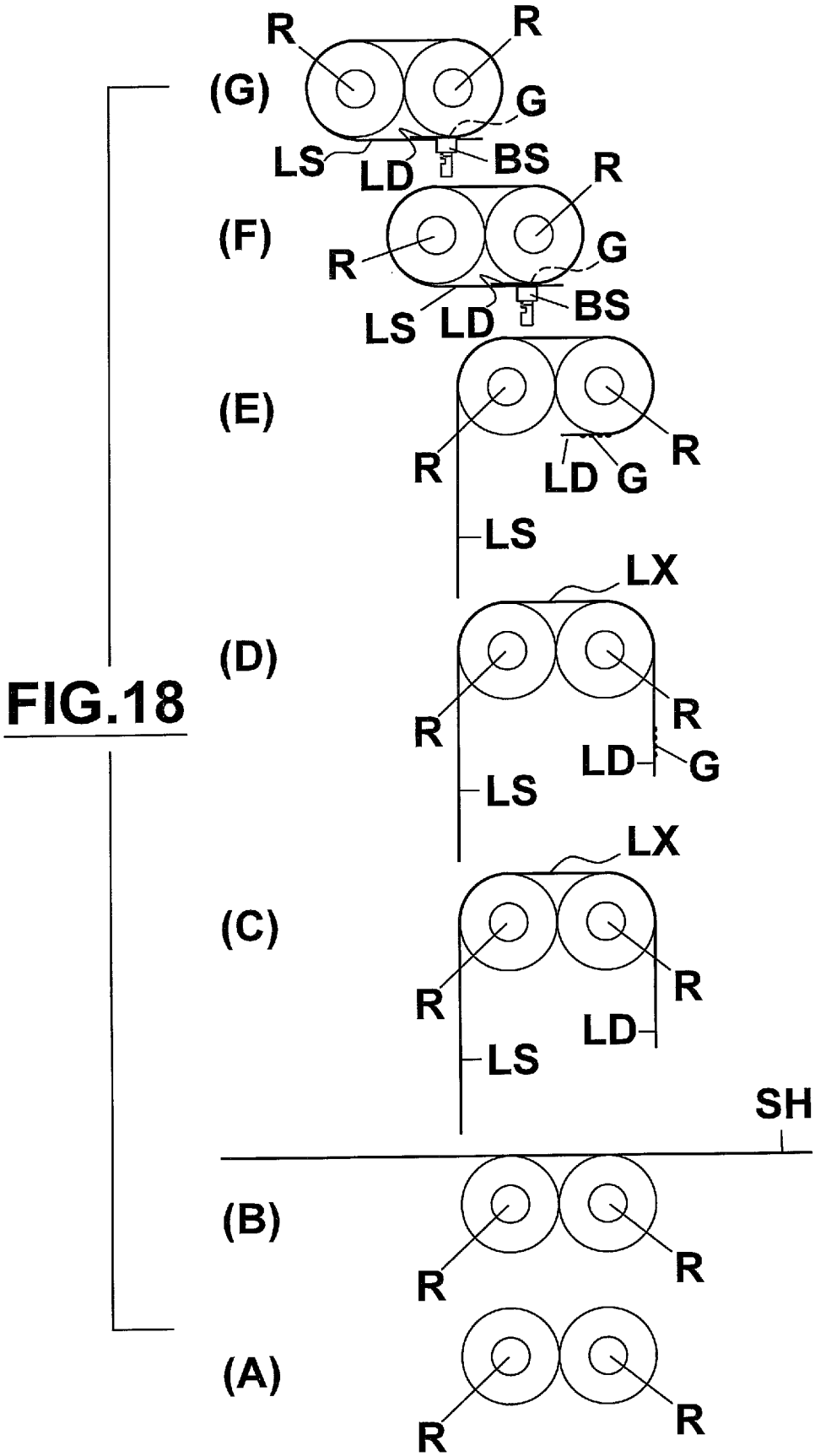
Figure 21:
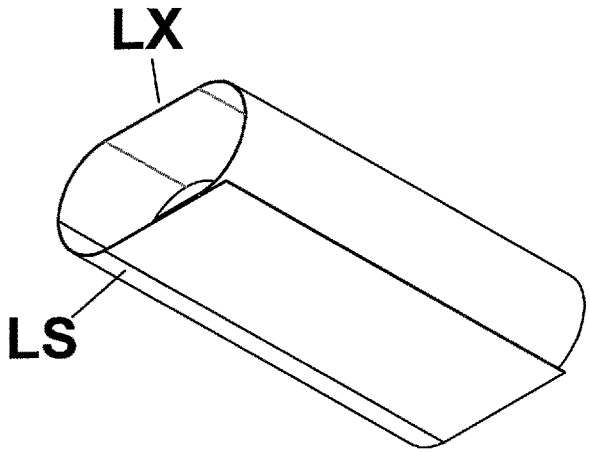
Figure 20:
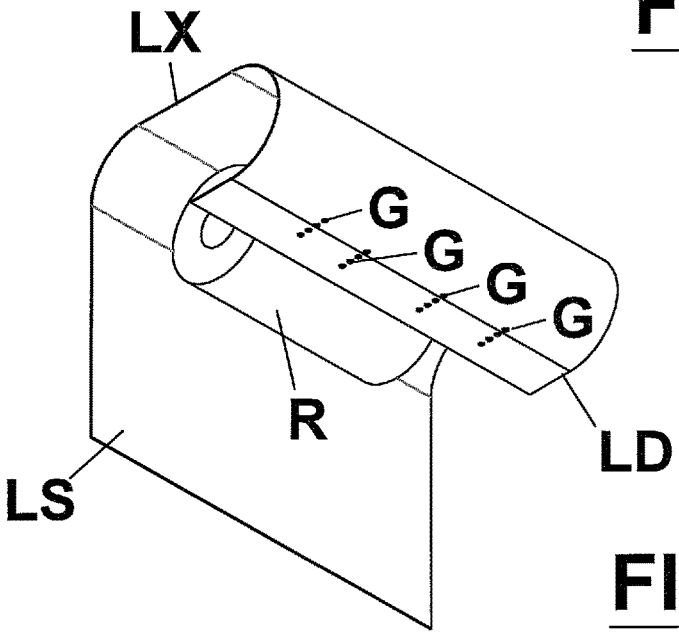
Figure 19:
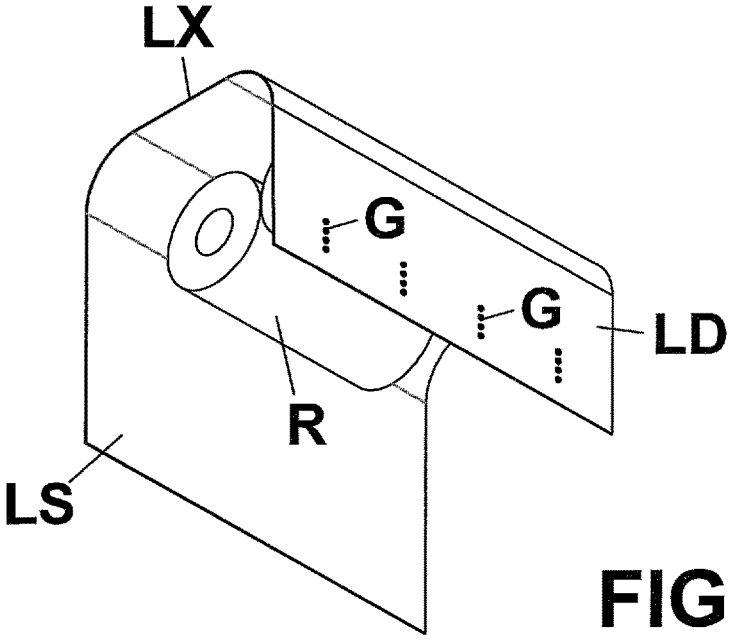
Figure 24:
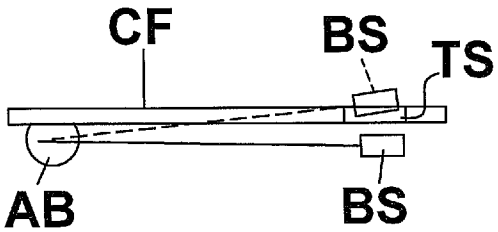
Figure 22:
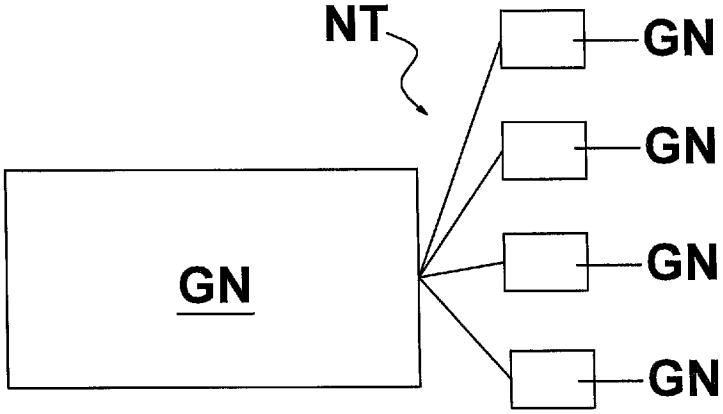
Figure 23:
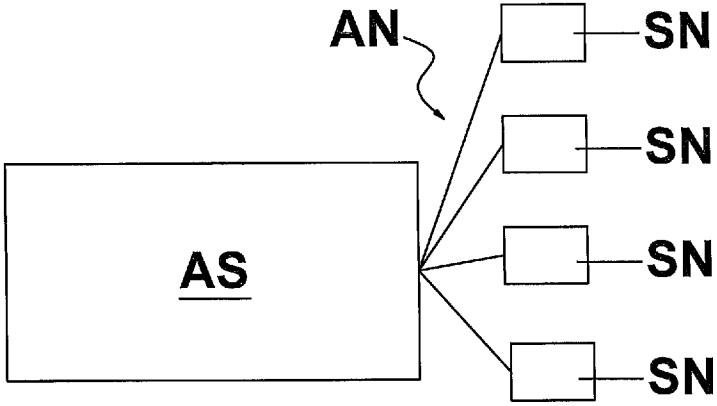

FIGS. 5-7 schematically represent different phases of the process of forming a head closure flap;

FIG. 8 is a schematic perspective representation of the glue dispensing mechanism in the entry station for the products to be packaged;

FIG. 9 is a front view of an upper surface of the product loading hopper;

FIG. 10 is a further view of the said upper surface of the product loading hopper;

FIGS. 11-17 schematically show the folding steps of the side flaps of the packaging sheet under the products;

FIGS. 18A-18G are a further graphic representation of the phases represented in FIGS. 11-17;

FIG. 19 is a schematic representation in perspective view of the phase shown in FIG. 18D;

FIG. 20 is a schematic representation in perspective view of the phase shown in FIG. 18E;

FIG. 21 is a schematic representation in perspective view of the phase shown in FIG. 18F;

FIG. 22 is a simplified block diagram relating to a possible method of feeding the glue dispensers (GN);

FIG. 23 is a simplified block diagram relating to a possible mode of feeding the suction nozzles (SN);

FIG. 24 schematically represents a junction unit with a movable pressure bar. Reduced to its essential structure and with reference to the example of embodiment shown in the attached drawings, a packaging machine (PM) according to the present invention is of the type comprising a machine body (MB) with an entry station (E) for the products, in particular paper rolls (R), arranged according to a predefined grouping order, with one or more rows of rolls arranged side by side so as to form a layer or more superimposed layers of rolls. In FIG. 1A the reference "MS" indicates a fixed frame of the machine that supports the operating components mentioned below. The machine (PM) also includes an exit station (U) for the finished packages and a sliding surface (Z) in the machine body (MB), between the entry station (E) and the outlet station (U), along which the packages being formed are moved. The machine body (MB) of the machine is the unit in which the packaging of the rolls materially takes place (R).

Figure 1B:
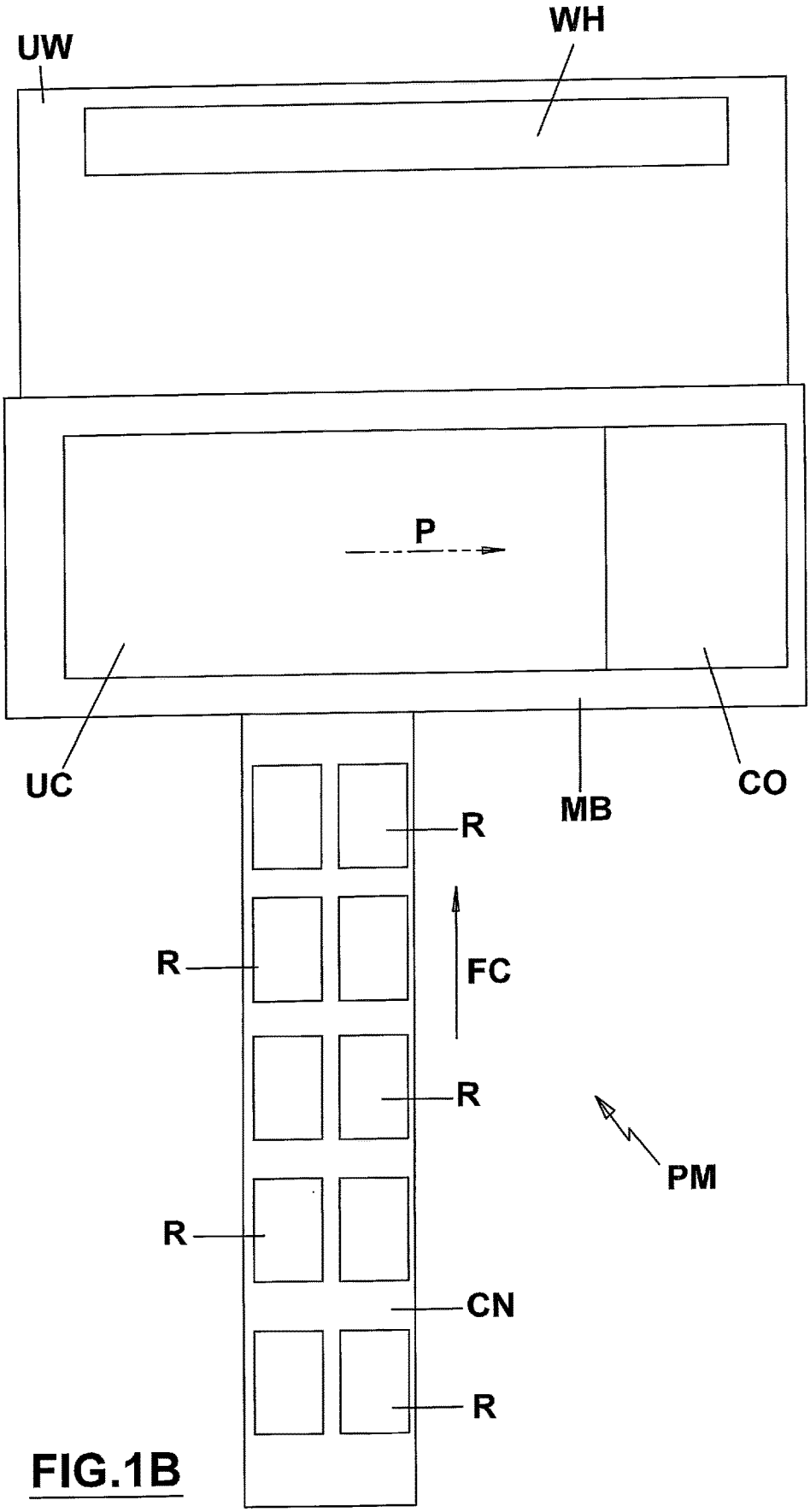
FIG. 1B represents a schematic top plan view of a packaging machine in accordance with the present invention.
Figure 2:
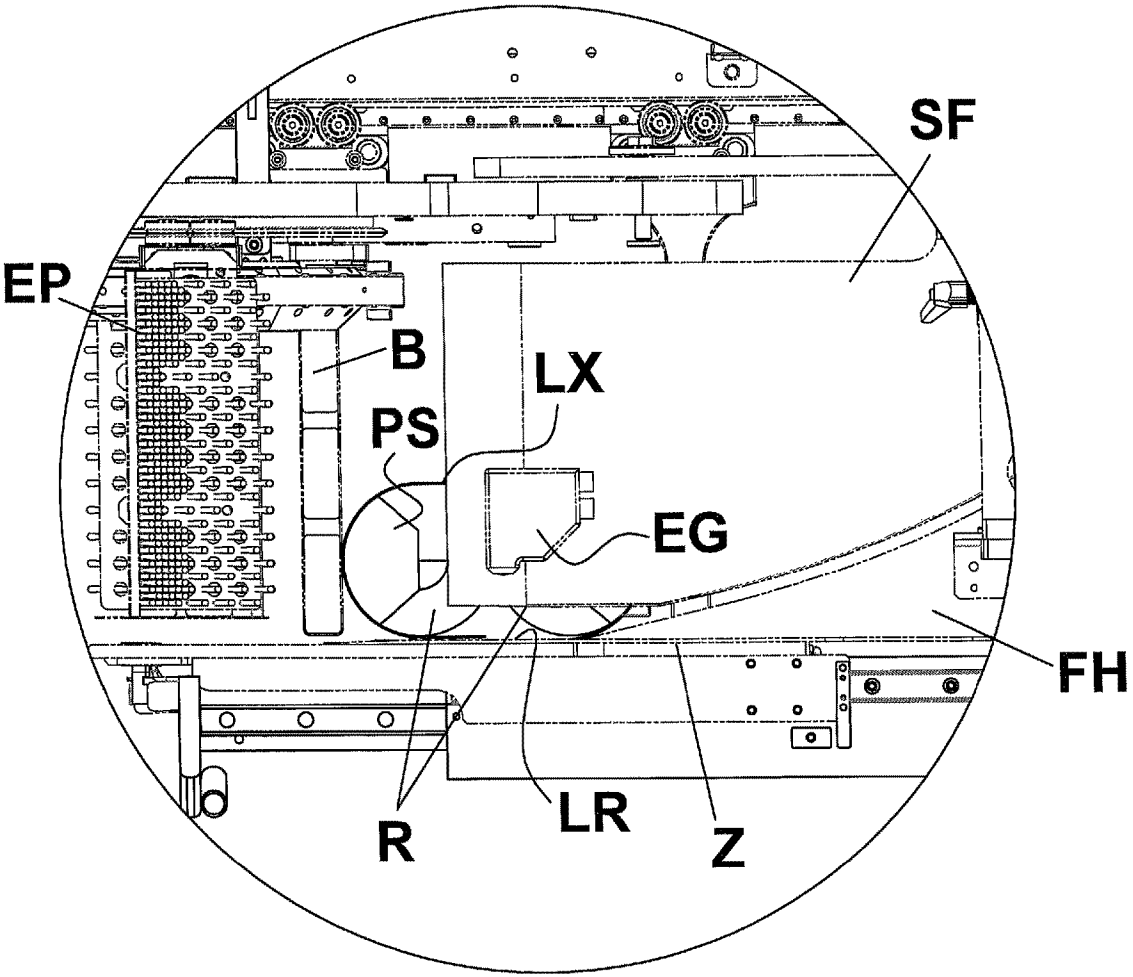
FIG. 2 is an enlarged detail of FIG. 1A.

The rolls (R) are introduced into said entry station by means of an elevator (EL), on which the groups of rolls to be packaged are previously formed. The rolls (R) are fed along a conveyor (CN), schematically illustrated in FIG. 1B, which transports them to the elevator (EL). The arrow "FC" in FIG. 1B indicates the direction followed by the rolls (R) on the conveyor (CN). In the example shown in FIG. 1B the conveyor is oriented orthogonally to the main body (MB) of the packaging machine.

The elevator (EL) is laterally delimited by a hopper (T) comprising two lower vertical walls (LL, LR) above which there are two corresponding upper vertical walls (UL, UR) such that between the lower walls and the upper walls of the loading hopper there is a space (H) of predetermined height that can be crossed by a packing sheet (SH).

In accordance with an operating scheme known per se to those skilled in the art, when the elevator (EL) lifts the rolls (R) through the station (E), as schematically indicated by the arrow "EU", the packing sheet (SH) is dragged upwards by the rolls themselves (R) and, thanks to the presence of the vertical walls (UL, UR), it wraps the rolls themselves on their upper side and laterally, forming the side flaps (LD, LS) and the upper flap (LX). In this phase, above the station (E) there are two blades (B) of a drive unit (UC) which form a compartment in which the rolls (R), the upper flap (LX) and the side flaps (LS, LD) of the packing sheet (SH) are inserted. At the end of this phase, the side flaps of the packaging sheet protrude below the rolls (R). Generally, the sheet (SH) is positioned, in the previous phase, in such a way that one of the side flaps (the left flap "LS" in the drawings) is longer than the other flap (the right flap "LD" in the drawings). At this point, the station (E) is closed, moving the folder (F) along the direction (P) and the counter-folder (CF) in the opposite direction. In this way, the folding of the protruding edges of the packaging sheet under the rolls (R), i.e. the lower folding of the packaging sheet, and the translation of the not yet completed package towards the exit (U) take place. Meanwhile, while the elevator is brought back to its starting height for receiving other rolls intended for packaging, the edges of the packaging sheet previously folded under the rolls (R) are joined. Said joining takes place according as described below.

Before introducing the rolls into the station (E), a packing sheet (SH) is placed on the rolls arranged on the elevator.

Figure 13:
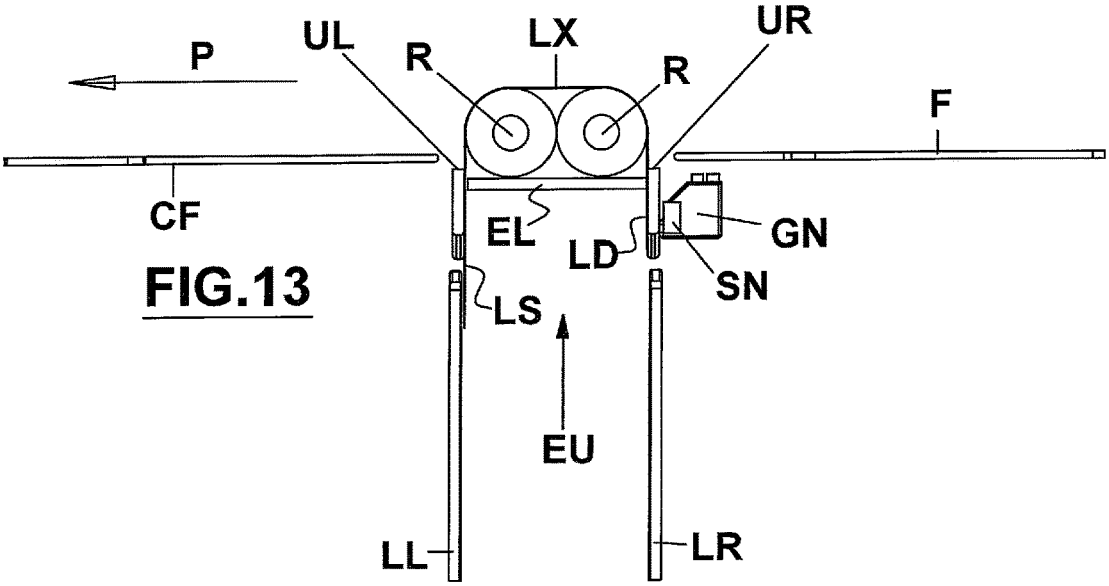

In a subsequent step of crossing the aforementioned entry station, the packaging sheet (SH) undergoes a first folding, wrapping the rolls upwards and laterally. Then, the mobile horizontal surfaces (F, CF) that make up the folder and the counter-folder, determine the folding of the flaps (LD, LS) of the packaging sheet protruding vertically on the sides of the package, so that the sheet also wrap the rolls at the bottom. In practice, after the lifting of the rolls by the elevator, the folder (F) and the counter-folder (CF) are moved in such a way as to intercept the flap (LD) and the flap (LS) respectively, causing them to fold under the rolls to be packaged. In this phase, the elevator (EL) is lowered, as schematically indicated by the arrow "ED". FIG. 13 shows the upper flap (LX) of the packaging sheet that is folded downwards in the elevation phase, i.e. in the transit phase of the rolls through the entry station (E), and the right and left side flaps (LD, IS). Since generally the sheet (SH) is positioned asymmetrically with respect to the elevator (EL), i.e. it. is not perfectly centered with respect to the latter, one side flap will generally be longer than the other at the end of the elevation phase. In the example shown in the drawing, the left side flap (LS) is longer than the right side flap (LD). In general, the longer side flap will be the one subject to the action of the counter-folder (CF). The folder (F) moves, during the folding operation of the respective flap (LD) of the packaging sheet (SH), in a direction concordant with the direction (P) followed by the rolls in the main body of the packaging machine. Vice versa, the counter-folder (CF) moves, during the folding operation of the respective flap (LS) of the packaging sheet (SH), opposite to said direction (P).

Figure 11:
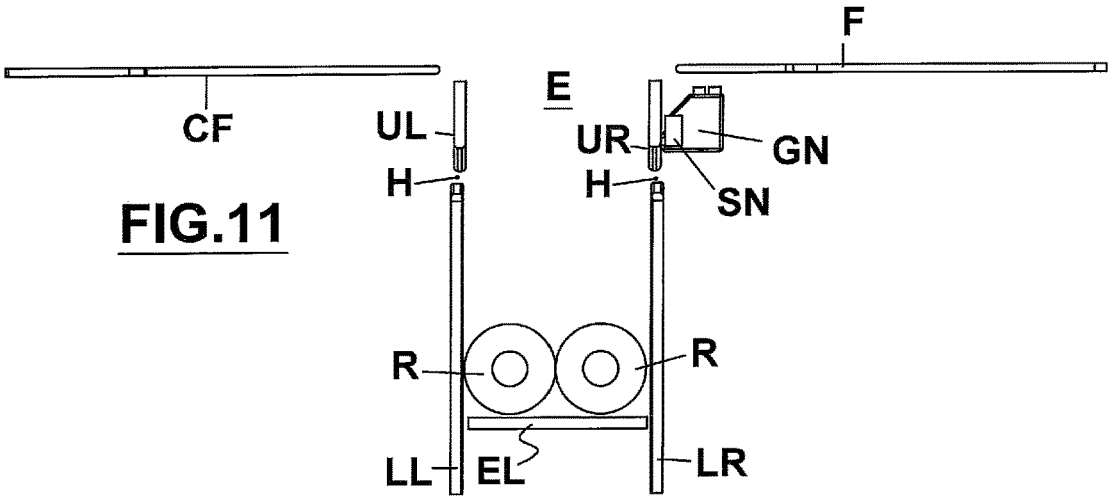
Figure 12:
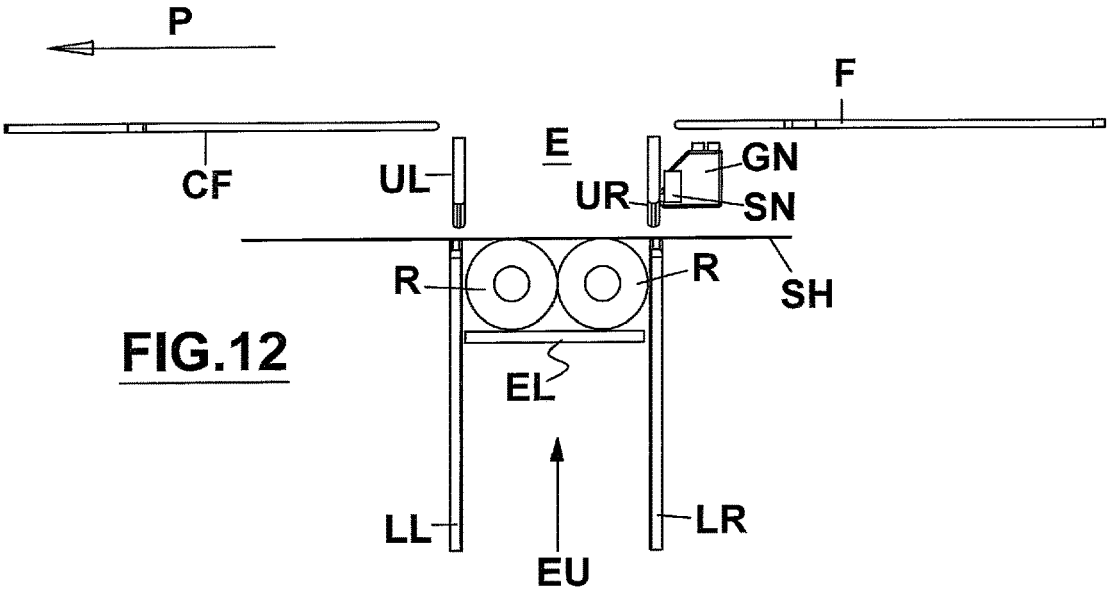
Figure 14:
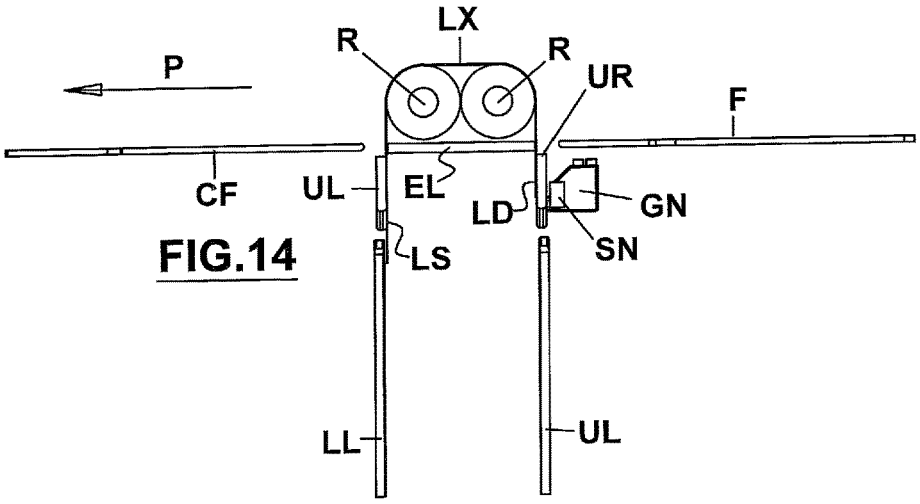
Figure 15:
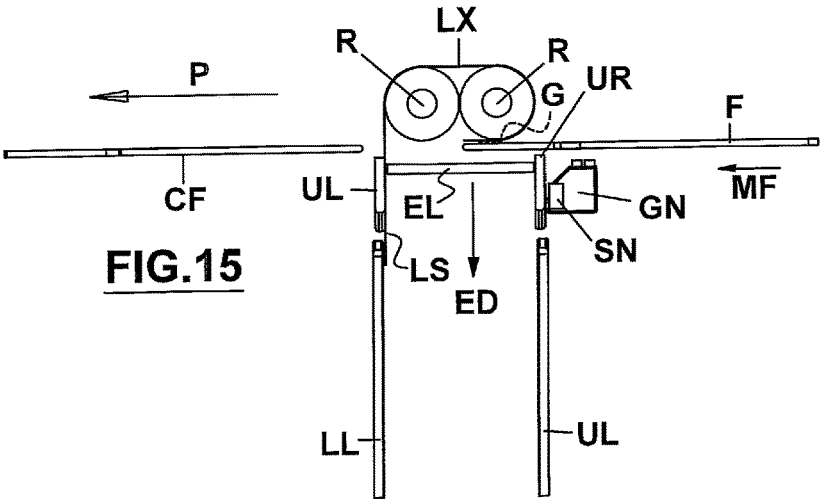
Figure 16:
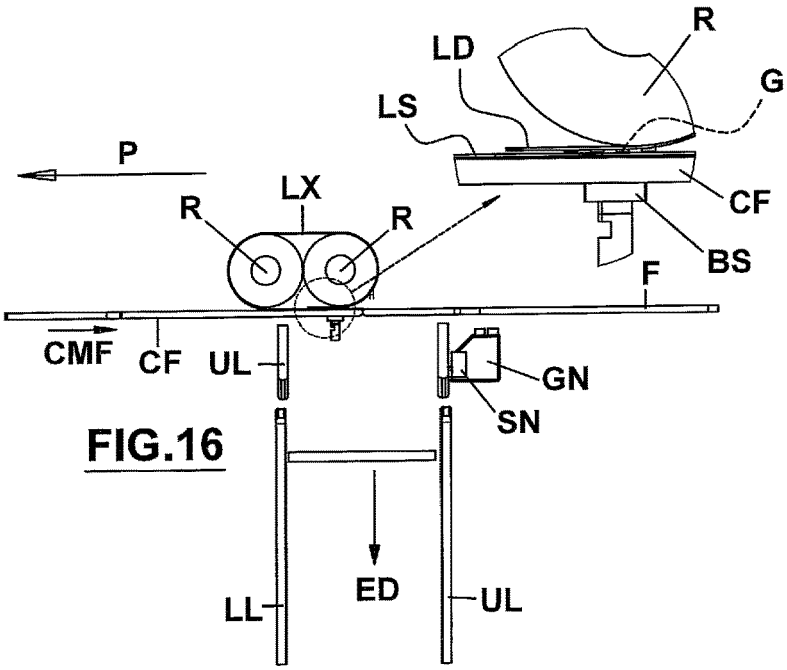
Figure 17:
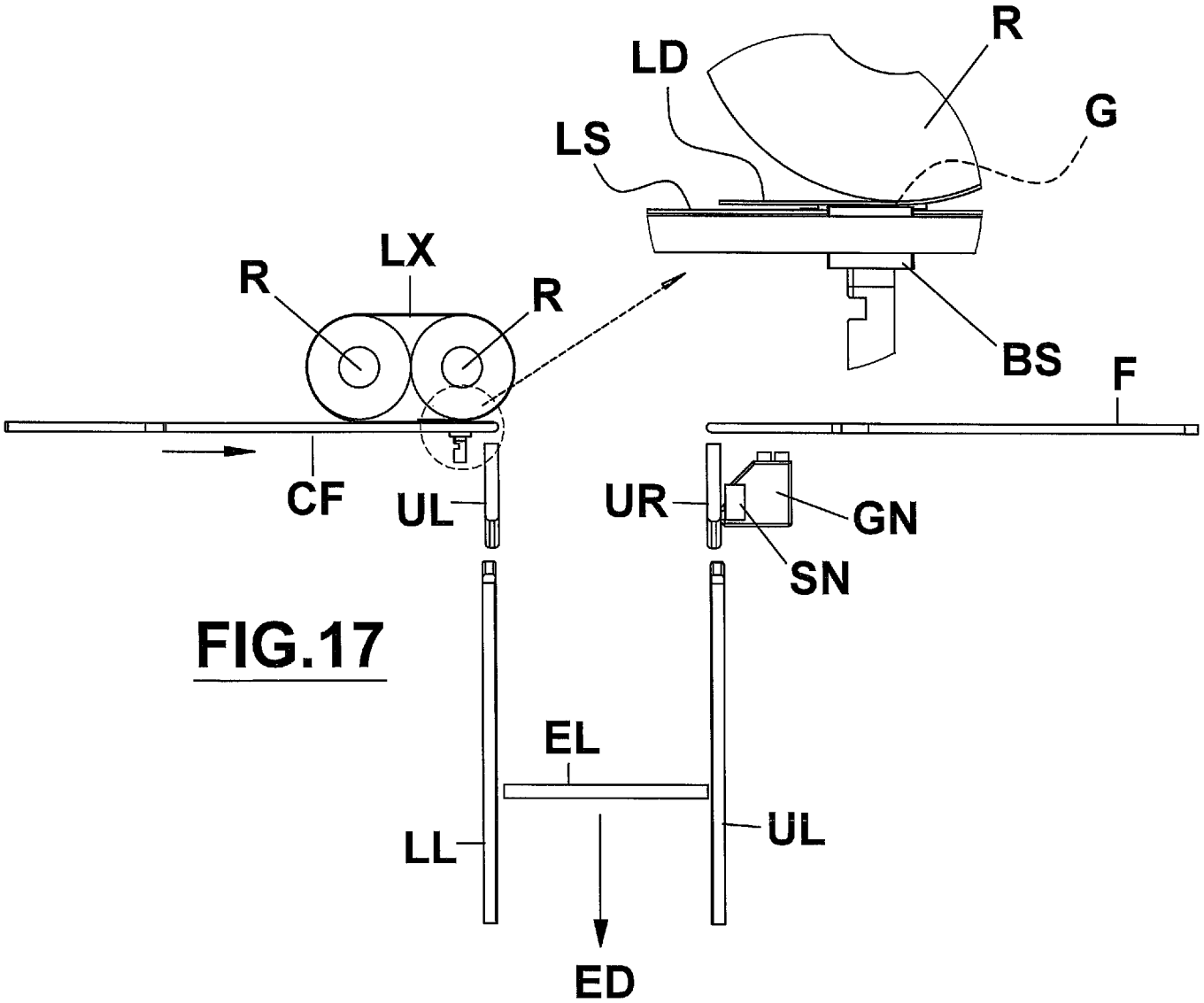

The formation of the lower flaps of the package is determined by the combined action of the folder (F) and the counter-folder (CF). With reference to the example shown in FIGS. 11-17 of the attached drawings, in a first phase the rolls (R) to be packaged, fed by the conveyor (CN), are positioned on the elevator (EL) that is arranged in a position of waiting for the rolls (FIG. 11). In a second phase, the packaging sheet (SH) is positioned through the aforementioned space (H) and the elevator (EL) is lifted, whereby the rolls (R) intercept the sheet (SH) (FIG. 12). In a third phase, while the lifting of the elevator (EL) continues, the rolls (R) are positioned in a compartment of the upper drive (UC) and the right and left side flaps (LD, LS) are formed while the upper flap (LX) covers the upper side of the rolls (FIGS. 13-14). In a subsequent phase, the folder (F) moves towards the counter-folder (CF), as indicated by the arrow "MF", intercepting the right side flap (LD) of the packaging sheet and causing the same flap to fold below the rolls (R) (FIG. 15). Subsequently, the counter-folder (CF) moves towards the folder (F), as indicated by the arrow "CMF", intercepting the left side flap (LS) and causing the folding of this flap under the rolls (R) and under the other flap (FIGS. 16-17). The movement of the counter-folder (CF) is coordinated with the movement, along the aforementioned direction (P), of the group formed by the rolls and the packaging sheet. This process is identical to that which takes place in conventional packaging machines in which the packaging sheet is made up of a film of plastic material.

A joining unit then joins the flaps (LD, LS) of the packing sheet to the bottom of the package. The execution of said junction is described below.

Inside the packaging machine (PM) the rolls to be packaged are moved along a substantially straight path (identified by the aforementioned direction P), developed between the entry station (E) and an exit station (U) for the completed packages, by means of the conveyor or "upper drive" (UC) comprising a plurality of pallets (B) configured to form a series of compartments in which the individual packages to be completed are received.

Inside the packaging machine, further folds of the edges of the packaging sheet are also carried out by means of a folding unit (FG) which acts on the two side heads of the packages to be completed to create a so-called "head" folding of the edges of the packaging sheet which are, in fact, in correspondence with the heads.

The folding unit (FG) comprises a plurality of movable side folders (EP) moved along two horizontal circuits (CR, CL) each of which has a forward section oriented in accordance with the direction (P) followed by the packages inside the machine and a return section along which the movable side folders move in the opposite direction with respect to the forward section.

Said circuits (CR, CL) are on opposite sides with respect to the center line of the machine (PM) and extend across the entry station (E).

The movable side folders (EP) consist of bodies that have a surface for contacting the packaging sheet. For example, the mobile folders (EP) can be shaped like brushes, constrained to respective carriages (CC) which guide them along the paths (CR, CL) as shown in the attached drawings.

The mobile side folders (EP) determine, on each head, the formation of a first side fold (PS), consisting of a portion of a side flap (the left flap in the attached drawings) and of the upper flap (LX) of the sheet (SH), which is pressed against the rolls (R).

Downstream of the circuits (CR, CL) with respect to direction (P) there are a fixed lateral counter-folder (SF) and a folding helix (FH).

The fixed lateral counter-folder (SF) consists of two vertical surfaces placed at the sides of the path followed by the packages being formed.

The fixed lateral counter-folder (SF) determines, on each head of the packages being formed, the formation of a second side fold (PD) consisting of a portion of the other side flap (the right flap in the attached drawings). Nozzles (not visible in the drawings) blow compressed air on the upper area of the package causing the formation of an upper fold (UP).

The aforementioned side folds do not involve the lower part of the sheet (SH) that, both after the folds performed by the folder (F) and the counter-folder (CF), and after the folds performed by the mobile side folders (EP) and the lateral fixed counter-folder (SF), still has two flaps (LF, LR) protruding inferiorly, in a substantially horizontal position, beyond the heads of the package being realized. The folding helix (FH) is formed by two helically shaped surfaces also placed on opposite sides with respect to the centerline of the machine (PM).

The folding helix (FH) determines, on each head of the package being formed, the lifting of the protruding flaps (LF, LR) and their positioning against the side folds (PD, PS), resulting in the formation of two head closing flaps (PH), one for each head, which overlap the other flaps.

The packaging sheet (SH) is unwound from a reel supported by an unwinder arranged in a predetermined point of the machine and associated with a cutting mechanism of the material unwound from the reel that produces sheets of paper material of predetermined length according to the format of the packages. The unwinder and the cutting mechanism are identical to those normally used to feed and cut the packaging sheets of plastic material used in traditional packaging machines and, therefore, will not be described in greater detail. In the attached drawings, said reel is represented only in the diagram of FIG. 1B, where it is marked by the reference "WH". In the same diagram, the reference "UW" indicates the unwinder, located on the opposite side of the conveyor (CN) with respect to the main body (MB).

In accordance with the present invention, the junction of the flaps (LD, LS) in the lower part of the package is carried out using adhesivation means arranged and acting at the rolls entry station (E) and intended to apply a predetermined amount of adhesive on a predetermined area of a side flap of the packing sheet (SH).

Preferably, in accordance with the present invention, said junction takes place during the formation of the lower flap (LS) formed by the counter-folder (CF). Furthermore, preferably, the adhesivation of the side flap of the packaging sheet is preceded by a phase of checking the vertical position of this flap. In the non limiting example shown in the attached drawings, the side flap of the sheet (SH) subjected to adhesivation is the right side flap (LD) subject to folding by the folder (F).

For example, said adhesivation means are constituted by a battery of dispensing nozzles (ON) located externally to an upper wall (UR) of the loading hopper (T), i.e. externally to the wall (UR) of the hopper (T) below the folder (F). Said wall (UR) is provided with holes (HR) through which the glue dispensed by the nozzles (ON) can flow.

For example, the dispensing nozzles (ON) are aligned horizontally, along said wall (UR). Preferably, the dispensing nozzles (ON) are equidistant from each other. Alternatively, the dispensing nozzles (ON) can also be arranged in non-equidistant positions.

Furthermore, preferably, the dispensing nozzles (ON) are positioned each in the lower part of a corresponding vertical groove (VN) formed on the internal side of said wall (UR), i.e. on the side of said wall facing the opposite wall (UL).

For example, the dispensing nozzles (GN) can consist of nozzles fed with liquid glue contained in a suitable tank (GT). The tank (GT) is shown only in the diagram of FIG. 22, in which the reference "NT" indicates a plurality of connection pipes between the tank (GT) and the dispensing nozzles (GN). The glue can be cold glue or hot glue, that is, glue that does not need to reach a minimum activation temperature or vice versa a glue that needs to reach a minimum temperature to perform its adhesive activity. Further information regarding the actuation of the joining phase of the flaps (LD, LS) by gluing are provided below.

Preferably, said means for controlling the position of the side flap (LD) of the sheet (SH) subjected to the application of the glue are pneumatic suction means arranged and acting on the same wall (UR) through which the means for applying the glue act. For example, said pneumatic suction means consist of several suction nozzles (SN) arranged at the sides of the glue application means and enslaved to a corresponding pneumatic suction device (AS). The pneumatic aspirator (AS) is represented only in the diagram of FIG. 23, in which the reference "AN" indicates a plurality of ducts connecting the aspirator (AS) with the suction nozzles (SN). Preferably, said suction nozzles (SN) are arranged between the glue dispensing nozzles, at the sides of the latter, and act through holes formed on the wall (UR) laterally to the holes (HR) through which the glue dispensing nozzles act.

Preferably, when the rolls (R) are lifted by the elevator (EL), i.e. in the phase in which the side flaps (LD, LS) of the packaging sheet (SH) are formed, the suction means (SM) are activated, in such a way as to maintain a flap (in the example represented in the drawing this is the flap "LD") adhering to the wall (UR) on which the dispensing nozzles (GN) act. During this phase the dispensing nozzles (GN) are activated, so that the glue (G) dispensed by the latter is distributed on the external side of the flap (LD). The grooves (VN) of the wall (UR) prevent the glue (G) from spreading on the same wall which therefore remains clean.

A bar (BS), acting as a presser, can be mounted on the counter-folder (CF). More specifically, in accordance with the example shown in the drawings, the bar (BS) is positioned in correspondence with a transverse opening (TS) of the counter folder (CF) and is connected with an actuator (AB) which controls the lifting and lowering thereof through the opening (TS). In the operational phase of folding the flap (LS) by the counter-folder (CF), the bar (BS) is lowered in such a way as not to compromise the folding operation. At the end of the operative phase of folding of the flap (LS) by the counter-folder (CF), the bar (BS) is raised so as to press the flap (LS) against the flap (LD) which has received the glue (G). In this way, the aforementioned joining of the flaps (LD) and (LS) under the rolls (R) is achieved. The bar (BS) with the actuator (AB) form the previously mentioned joining unit. The actuator (AB) is schematically represented in FIG. 24, in which the lowered position of the bar (BS) is represented with solid lines while the raised position is represented in dotted lines.

In practice, the bar (BS) is a presser, mounted on the counter-folder (CF), configured and controlled to compress the flap (LS) on the glued flap (LD).

The bar (BS) can optionally be a heated bar suitable for administering heat during the execution of the aforementioned joining of the flaps (LD) and (LS) below the rolls (R). This allows the use of glue which can be activated by administering heat.

Preferably, the folder (F) has a series of longitudinal grooves (GF), formed along lines that ideally intercept the vertical grooves (VN) formed in the wall (UR), so that the glue (G) does not come into contact with the same folder (F) when this is moved to fold the flap (LD) that has received the glue (G).

Figure 4:
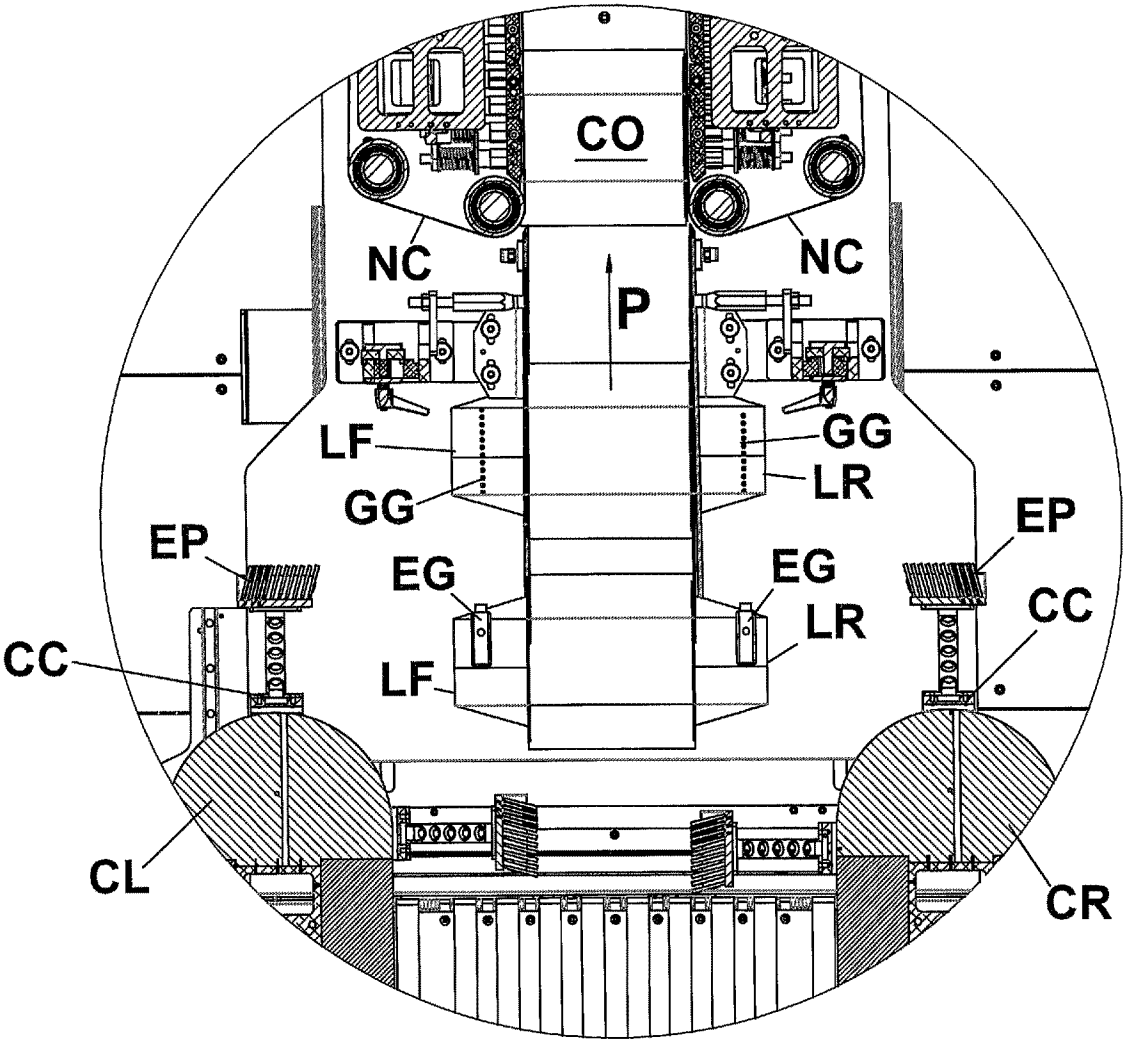
FIG. 4 is an enlarged detail of FIG. 3.

Furthermore, advantageously, in accordance with the present invention, the packaging machine (PM) comprises further sizing means, arranged between the side folding unit (FG) and the folding helices (FH), suitable for dispensing glue (GG) also on the inner side (side facing up) of the aforementioned protruding flaps (LF, LR). For example, said further sizing means comprise two dispensers (EG) arranged in pre-established opposite positions with respect to the center line of the machine (PM), i.e. along the path followed by the packages being formed inside the machine. The glue (GG) supplied by the additional sizing means (EG) allows the gluing of the head closing flaps (PH) on the side folds (PD, PS). As shown in FIG. 4, the dispensers (EG) can be arranged in such a way that on each flap (LF, LR) a line of glue is formed, oriented parallel to the direction (P) of advancement of the packages being formed along the plane (Z) of the machine. In. FIG. 4 said glue lines are graphically represented as a succession of points.

It is understood that said dispensers (EG) may be in a greater number than those exemplified in the drawings, depending on the dimensions of the packaging sheet, i.e. the dimensions of the package to be made.

Figure 3:
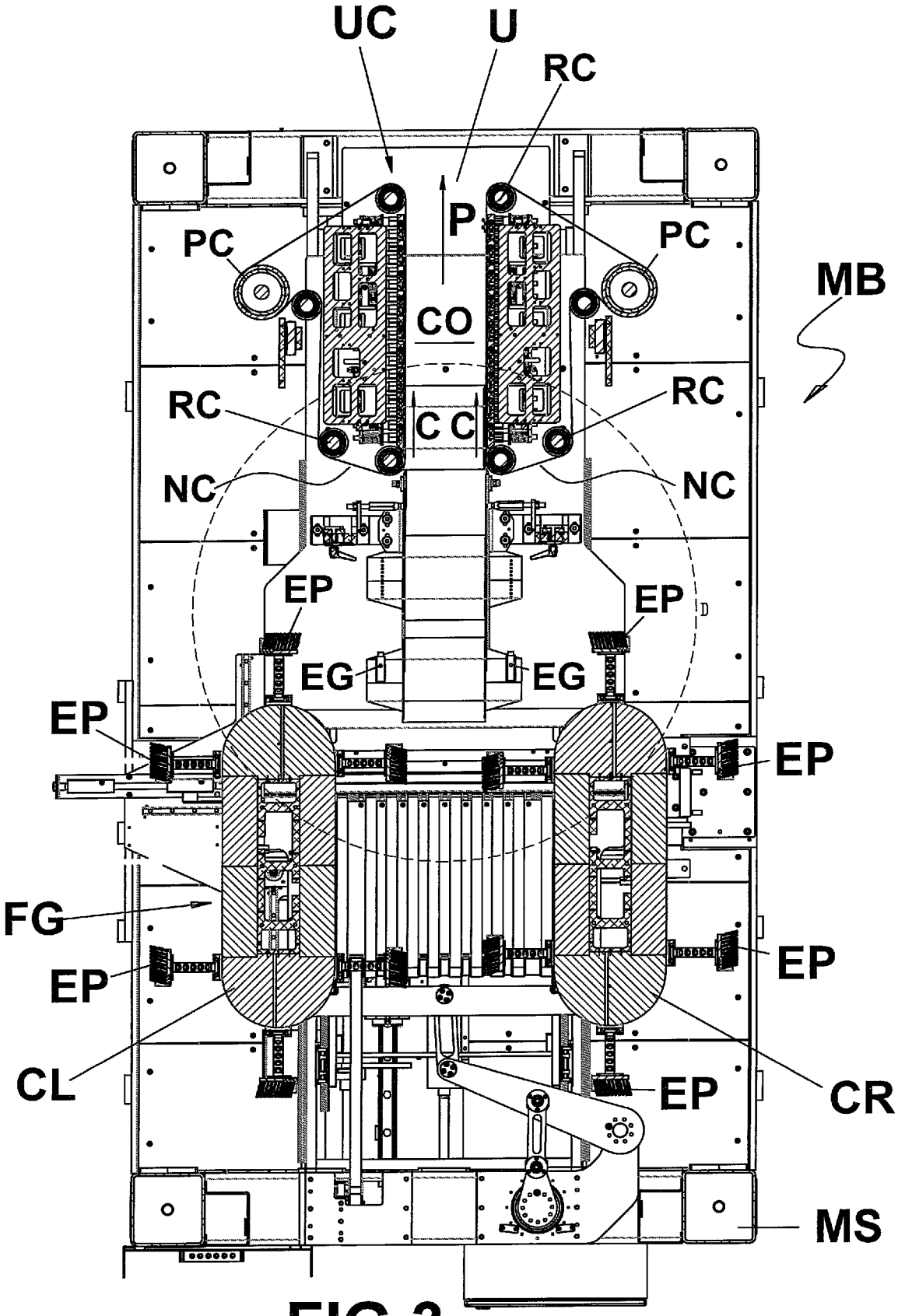
FIG. 3 is a schematic horizontal sectional view of the unit shown in FIG. 1A.

Downstream of the folding helices (FH), a compression unit (UC) of the head closing flaps (PH) is preferably arranged to facilitate the gluing of the latter to the side flaps (PD, PS). For example, the compression unit (UC) is formed by a compression corridor (CO) developed along the direction (P) of movement of the packages, arranged upstream of the outlet section (U). For example, the compression lane (CO) is delimited, on both sides, by two corresponding motorized belts (NC) which have a forward section in accordance with the direction (P) followed by the packages and a return section that moves in the direction opposite. In the example shown in FIG. 3, the belts (NC) are guided on a series of rollers (RC) which delimit two closed paths on the sides of the compression corridor (CO) in which a pulley (PC) enslaved to a corresponding rotary actuator that controls the movement of the belts (NC) along their respective paths. The arrows "C" in FIG. 3 indicate the direction of the belts (NC) in the compression corridor (CO). The motorized belts (NC) can be heated, if required, to further facilitate the gluing of the head closing flaps (PH) on the side flaps (PD, PS), in particular if the glue dispensed by the dispensers (G) is activatable glue hot, i.e. by administering heat.

The blades (B) of the upper drive unit (UC) push the packages along the path (P) up to the compression lane (CO) where the packages are taken over by the motorized belts (NC).

The operating procedure described above is also applicable to the case of packaging of individual rolls with a packing sheet of paper material.

A packaging machine according to the present invention is, therefore, a machine comprising:

a packaging unit (MB) with an entry station (E) having means (EL) for arranging one or more paper rolls (R) in a configuration suitable for their packaging with a packaging sheet (SH) of material paper so as to realize packages comprising an upper side (LX), a lower side formed by the junction of two side flaps of the packaging sheet folded under the rolls, side folds (PD, PS), a first head flap (UP) and a head closure flap (PH) on each head, the latter being formed by a flap overlapping and joined to the other flaps (PD, PS, UP);

means (UW, WH) for feeding a packaging sheet (SH) of paper material to said inlet station (E);

folding means (F, CF) apt to fold two side flaps (LD, LS) of the packaging sheet (SH) under the rolls;

joining means for joining said flaps (LD, LS) to one another under the rolls;

handling means (UC) for moving the packages being formed along a predefined direction (P) inside the machine;

means (FG, SF) configured for forming two side folds (PD, PS) on each of the two heads of each package while the packages advance along said direction (P);

means (FH) configured for forming a head closure flap (PH) on each head of the package;

and further comprising:

first adhesivation means (GN) suitable for applying an adhesive substance (G) on an external side (LD) of the packaging sheet (SH), arranged and acting upstream of the folding means (F, CF) so as to make said side adhesive before folding it under the rolls (R);

second adhesivation means (EG) adapted to apply an adhesive substance (GG) on an internal side of said side folds (PD, PS), arranged and acting downstream of the first adhesivation means and upstream of said means for forming the head closing flaps (PH) with respect to said direction (P).

The first adhesivation means (GN) are arranged and acting in the inlet station (E), on one side of a hopper (T) for loading the rolls (R), such that the adhesiveness of said side takes place while the rolls (R) pass through the inlet section (E).

Moreover, preferably, according to the example disclosed above, the first adhesivation means (ON) consist of a battery of nozzles adapted for dispensing glue through holes (HR) made in a wall of said hopper (T).

Again, preferably, the first adhesivation means (GN) are configured to apply the adhesive substance on the external side of said side flap (PD) when the latter is in a vertical position adhering to a vertical wall of the hopper (T). Therefore, preferably, a packaging machine according to the present invention comprises means (SN) adapted to pneumatically attract said sheet side towards a side wall of the hopper (T) where the first adhesive means are also arranged and acting. Furthermore, preferably, a packaging machine according to the present invention may have one or more of the following features, also combined with each other:

the first adhesivation means (ON) consist of a battery of nozzles adapted for dispensing glue arranged externally to an upper wall (EIR) of said loading hopper (T), said wall (EIR) being provided with holes through which the nozzles (ON) act.

said nozzles (ON) are aligned along a predefined direction, parallel to said wall (EIR).

the nozzles are positioned each in the lower part of a corresponding vertical groove (VN) formed on an internal side of said wall (EIR).

the means for controlling the attitude of a side flap (LD) of the sheet (SH) subjected to adhesivation are pneumatic suction means arranged and acting on the same wall (EIR) of the machine through which the first adhesivation means act.

the folding means for folding the side flaps (LD, LS) of the packaging sheet under the rolls comprise a counter-folder (CF) on which a bar (BS) is mounted and acts as a presser in the joining phase of said flaps (LD, LS). said bar (BS) can be a heatable bar.

the means for folding the side flaps (LD, LS) of the packaging sheet under the rolls comprise a folder (F) having a series of longitudinal grooves (GF).

the second adhesivation means comprise a plurality of dispensers (EG) arranged in pre-established opposite positions with respect to the center line of the machine (PM), i.e. along the path followed by the packages being formed inside the machine.

downstream of the means for forming the head closing flaps there is a compression unit (UC) for the head closing flaps (PH)

said compression unit (UC) is formed by a compression lane (CO) developed along the direction (P) of movement of the packages, arranged upstream of the machine outlet section (U).

the compression lane (CO) is delimited, on both sides, by two corresponding motorized webs (NC) which have a forward section moving along the direction (P) followed by the packages and a return section that moves in the opposite direction.

said motorized webs (NC) are heated, if required, for further favor the gluing of the head closing flaps (PH) on the other flaps (PD, PS, UP).

The upper drive (UC), as the folding unit (FG), the horizontal folder (F), the horizontal mobile counter-folder (CF), the vertical fixed counter-folder (SF) and the helix (FH) operate in a known manner.

In practice, the details of execution can in any case vary in an equivalent way as regards the individual elements described and illustrated, without thereby departing from the scope of the solution adopted and therefore remaining within the limits of the protection granted to this patent in accordance with the following claims.

The invention claimed is:

1. Packaging machine comprising:

a packaging unit with an entry station having an elevator for arranging one or more paper rolls in a configuration suitable for their packaging with a packaging sheet of paper material so as to realize packages comprising an upper side, a lower side formed by the junction of two side flaps of the packaging sheet folded under the rolls, side folds, a first head flap and a head closure flap on each head, the latter being formed by a flap overlapping and joined to the other flaps;

packaging sheet feeding means for feeding a packaging sheet of paper material to said entry station, the packaging sheet feeding means comprising an unwinder for supporting a packaging sheet reel;

folding means comprising mobile horizontal surfaces apt to fold two side flaps of the packaging sheet under the rolls;

joining means comprising a presser for joining said side flaps to one another under the rolls;

conveyor means for moving the packages being formed along a predefined direction inside the machine;

a folding unit comprising movable side folders and a fixed lateral counter-folder configured for forming two side folds on each of the two heads of each package while the packages advance along said direction;

head closure means comprising helically shaped surfaces configured for forming a head closure flap on each head of the package;

the packaging machine further comprising:

first adhesivation means comprising dispensing nozzles suitable for applying an adhesive substance on an external side of the packaging sheet, arranged and acting upstream of the folding means so as to make said side adhesive before folding it under the rolls;

second adhesivation means comprising a glue dispenser structure adapted to apply an adhesive substance on an internal side of said side folds, arranged and acting downstream of the first adhesivation means and upstream of said means for forming the head closing flaps with respect to said direction and the first adhesivation means are arranged and acting in the entry station, on one side of a hopper for loading the rolls, such that the adhesivation of said side flap takes place while the rolls pass through the entry station.

2. Machine according to claim 1, characterized in that the first adhesivation means consist of a battery of nozzles adapted for dispensing glue through holes formed in a wall of said hopper.

3. Machine according to claim 2 characterized in that it comprises suction nozzles adapted to pneumatically attract said sheet side towards a side wall of the hopper where the first adhesive means are also arranged and acting.

4. Machine according to claim 1 characterized in that the first adhesivation means are configured to apply the adhesive substance on the external side of said sheet side arranged in a vertical position adhering to a vertical wall of the hopper.

5. Machine according to claim 1 characterized in that the first adhesivation means consist of a battery of nozzles adapted for dispensing glue.

6. Machine according to claim 1 characterized in that the first adhesivation means are constituted by a battery of nozzles adapted for dispensing glue and arranged externally to an upper wall of the loading hopper, said wall being provided with holes through which the nozzles act.

7. Machine according to claim 6 characterized in that said nozzles are aligned along a predefined direction, parallel to said wall.

8. Machine according to claim 7 characterized in that said nozzles are each positioned in the lower part of a corresponding vertical groove formed on an internal side of said wall.

9. Machine according to claim 1 characterized in that it comprises means for controlling the attitude of a side of the sheet subjected to adhesivation, said control means being pneumatic suction means comprising suction nozzles arranged and acting on a same wall of the machine through which the first adhesivation means act.

10. Machine according to claim 1 characterized in that the folding means for folding the side flaps of the packaging sheet under the rolls comprise a counter-folder on which a bar is mounted and acts as a presser in the joining phase of said sheet side flaps.

11. Machine according to claim 10 characterized in that said bar is a heatable bar.

12. Machine according to claim 1 characterized in that the means for folding the side flaps of the packaging sheet under the rolls comprise a folder which has a series of longitudinal grooves.

13. Machine according to claim 1 characterized in that the second adhesivation means comprise a plurality of dispensers arranged in pre-established opposite positions with respect to the center line of the machine, i.e. along the path followed by the packages being formed inside the machine.

14. Machine according to claim 1 characterized in that downstream of the means for forming the head closing flaps there is a compression unit for the head closing flaps.

15. Machine according to claim 14 characterized in that said compression unit is formed by a compression lane developed along the direction of movement of the packages, arranged upstream of the machine outlet section.

16. Machine according to claim 15 characterized in that the compression lane is delimited, on both sides, by two corresponding motorized webs which have a forward section moving along the direction followed by the packages and a return section that moves in the opposite direction.

17. Machine according to claim 16 characterized in that said motorized webs are heated.

* * * * *